US006865360B2

(12) United States Patent
Takahashi et al.

(10) Patent No.: US 6,865,360 B2
(45) Date of Patent: Mar. 8, 2005

(54) IMAGE FORMING APPARATUS AND TONER DISCHARGE CONTROL METHOD

(75) Inventors: Masashi Takahashi, Kanagawa-ken (JP); Masashi Hiroki, Kanagawa-ken (JP); Takeshi Watanabe, Chiba-ken (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 45 days.

(21) Appl. No.: 10/615,993

(22) Filed: Jul. 10, 2003

(65) Prior Publication Data

US 2004/0009014 A1 Jan. 15, 2004

(30) Foreign Application Priority Data

Jul. 11, 2002 (JP) ..... 2002-202433

(51) Int. Cl.[7] ..... G03G 15/08
(52) U.S. Cl. ..... 399/257
(58) Field of Search ..... 399/257, 222, 399/252, 264

(56) References Cited

U.S. PATENT DOCUMENTS 6,029,033 A 2/2000 Kawasaki

FOREIGN PATENT DOCUMENTS

| | | | | |
|---|---|---|---|---|
| JP | 61022362 A | * | 1/1986 | ..... G03G/15/00 |
| JP | 11-249452 A | | 9/1999 | |
| JP | 2001-188394 A | | 7/2001 | |
| JP | 2001-356570 A | | 12/2001 | |

OTHER PUBLICATIONS

U.S. Appl. No. 10/385,716, Aoki et al., filed Mar. 12, 2003.

* cited by examiner

*Primary Examiner*—Quana Grainger
(74) *Attorney, Agent, or Firm*—Foley & Lardner LLP

(57) ABSTRACT

In an image forming apparatus having a plurality of developing devices, the timing for discharging toner in a developing device, in which toner of a previously formed toner image has mixed, is determined by comparing an integrated area of a toner image developed by an upstream-side developing device and an integrated area of a toner image developed by this developing device.

1 Claim, 7 Drawing Sheets

IMAGE FORMING APPARATUS AND TONER DISCHARGE CONTROL METHOD

CROSS-REFERENCE TO RELATED APPLICATIONS

This application is based upon and claims the benefit of priority from the prior Japanese Patent Application No. 2002-202433, filed Jul. 11, 2002, the entire contents of which are incorporated herein by reference.

BACKGROUND OF THE INVENTION

1. Field of the Invention

The present invention relates to an image forming apparatus, such as a copying machine, a facsimile or a printer, which forms an image using electrophotography, and to a mixed toner discharge control method.

2. Description of the Related Art

Jpn. Pat. Appln. KOKAI Publication No. 2001-188394 discloses a technique relating to cleaning of toner in a developing device in a color image forming apparatus, in a case where toner of a previously developed toner image is reversely transferred and mixed in the developing device that subsequently develops a toner image.

According to this technique, in an image forming apparatus having a plurality of image forming sections, when an image ratio of an image formed in one of two adjacent image forming sections, which is disposed at a rear stage, is lower than an image ratio of an image formed in the image forming section at a front stage, the image forming section at the rear stage operates to forcibly consume a developer, in addition to toner consumption in an ordinary image forming operation.

This technique, however, has the following problem.

For example, in an image forming apparatus that performs image formation using four color toners, assume that image forming sections, the number of which is equal to the number of colors, i.e. four, are provided. In this technique, only the operation of the image forming section, which has performed an image forming operation immediately before, is monitored. Thus, no consideration is given to mixing of toner in image forming sections that form third and fourth toner images, relative to the image forming section that forms a first toner image. As a result, even if toning of color tone of toner images formed in the third and fourth image forming sections has varied, forcible discharge of developer is not performed.

BRIEF SUMMARY OF THE INVENTION

An advantage of an aspect of the present invention is to provide an image forming apparatus and a mixed toner discharge control method, which can constantly maintain the toning of color tone of toner images by discharging mixed toner at a suitable timing, even if a previously formed toner image mixes in an image forming section that performs a subsequent image forming operation.

The invention may provide an image forming apparatus comprising: a first image carrying body that carries a first electrostatic latent image; a first developing device that develops the first electrostatic latent image formed on the first image carrying body into a first toner image, and removes excess toner on the first image carrying body; a second image carrying body that carries a second electrostatic latent image; a second developing device that develops the second electrostatic latent image formed on the second image carrying body into a second toner image, and removes excess toner on the second image carrying body; a third image carrying body that carries a third electrostatic latent image; and a third developing device that develops the third electrostatic latent image formed on the third image carrying body into a third toner image, and removes excess toner on the third image carrying body, wherein the third developing device performs a toner discharge operation on the basis of a result of a comparison between one of an integrated area of the first toner image and an integrated area of the second toner image, on the one hand, and an integrated area of the third toner image, on the other.

The invention may also provide a mixed toner discharge control method for an image forming apparatus having a first developing device that performs development using a first toner, a second developing device that performs development using a second toner, a third developing device that performs development using a third toner and a fourth developing device that performs development using a fourth toner, wherein a toner image using the first toner is first formed on paper supplied, following which a toner image using the second toner is formed in an overlapping manner, a toner image using the third toner is formed in an overlapping manner and then a toner image using the fourth toner is formed in an overlapping manner, the method comprising: controlling a discharge operation for the first toner mixed in the second developing device, in accordance with an integrated area developed by the first developing device and an integrated area developed by the second developing device; controlling a discharge operation for the first and second toners mixed in the third developing device, in accordance with an integrated area developed by the first developing device, an integrated area developed by the second developing device and an integrated area developed by the third developing device; and controlling a discharge operation for the first, second and third toners mixed in the fourth developing device, in accordance with an integrated area developed by the first developing device, an integrated area developed by the second developing device, an integrated area developed by the third developing device and an integrated area developed by the fourth developing device.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

An embodiment of the present invention will now be described with reference to the accompanying drawings.

Figure 1:
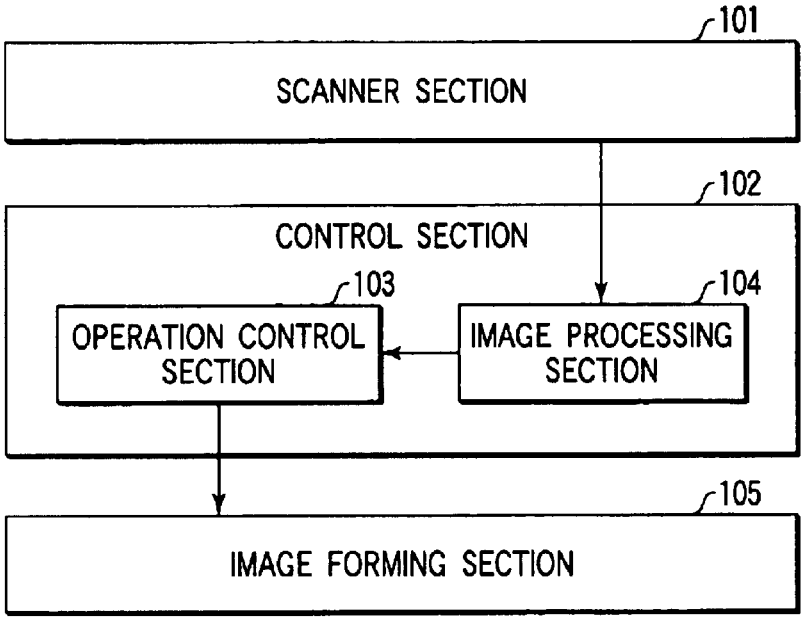
FIG. 1 is a block diagram showing a main structure of an image forming apparatus according to the present invention.

FIG. 1 is a block diagram of a main structure of an image forming apparatus 1 according to an embodiment of the invention.

The image forming apparatus 1 comprises a scanner section 101, a control section 102, and an image forming section 105. The control section 102 includes an operation control section 103 and an image processing section 104.

The scanner section 101 reads an image on a color original and generates image data on the basis of color information relating to red, green, blue and black. The scanner section 101 outputs the image data to the control section 102.

The image processing section 104 of control section 102 converts the input image data to image data of four colors, yellow, magenta, cyan and black.

The operation control section 103 of control section 102 receives the converted four-color image data and controls the image forming section 105 on the basis of this data, thereby performing a control for forming a toner image on paper P.

Figure 2:
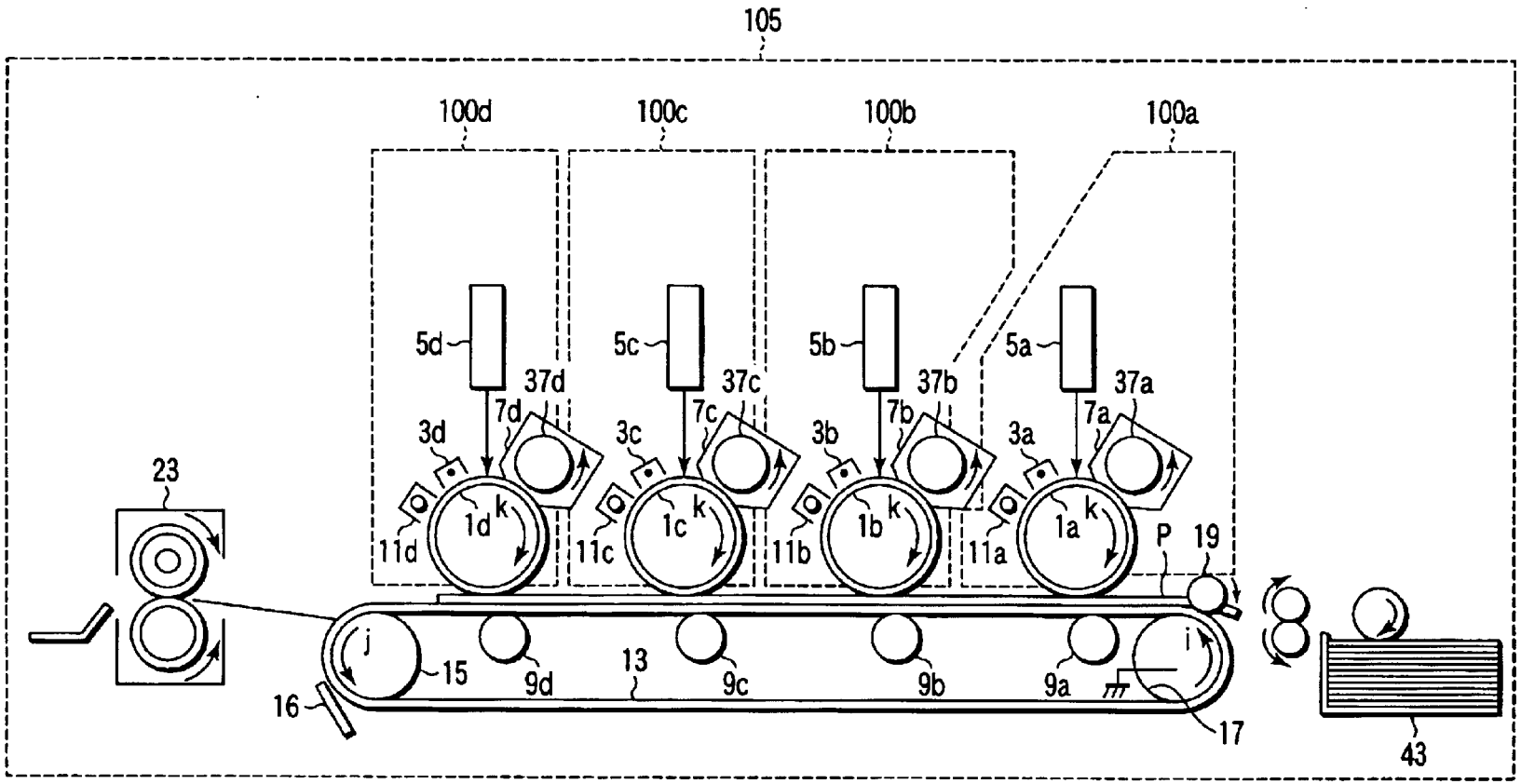
FIG. 2 shows an image forming section according to a first embodiment of the invention.

FIG. 2 shows a detailed structure of the image forming section 105.

The image forming section 105 includes a first process unit 100*a*, a second process unit 100*b*, a third process unit 100*c* and a fourth process unit 100*d*.

A photosensitive drum la of the first process unit 100*a* is rotated in a direction of an arrow in FIG. 2.

A charging device 3*a* for negatively charging the surface of the photosensitive drum 1*a* is disposed to face the surface of the photosensitive drum 1*a*.

An exposing device 5*a* is disposed at a position where the exposing device 5*a* faces a part of the photosensitive drum 1*a* charged by the charging device 3*a*, when the photosensitive drum 1*a* is rotated, and exposes the part to form an electrostatic latent image.

A developing device 7*a* is disposed at a position where the developing device 7*a* faces the part of the photosensitive drum 1*a* on which the electrostatic latent image is formed by the exposing device 5*a*, when the photosensitive drum 1*a* is rotated, and applies a developer contained in the developing device 7*a* to the electrostatic latent image, thereby developing it into a toner image. The developing device 7*a* has a developing roller 37*a*.

A convey belt 13 for conveying paper P is disposed at a position where the convey belt 13 comes in contact with the part of the photosensitive drum 1*a* on which the electrostatic latent image is developed into the toner image by the developing device 7*a*, when the photosensitive drum 1*a* is rotated.

The convey belt 13 is rotated by a driven roller 15 and a driving roller 17, and conveys the paper P from an upstream side to a downstream side. The upstream side and the downstream side, in this context, refer to an upstream side and a downstream side in the direction in which the convey belt 13 conveys the paper P.

The convey belt 13 attracts, by electrostatic force, the paper P charged by an attraction device 19. In order to stably maintain electrostatic force between the convey belt 13 and paper P, the driving roller 17 and driven roller 15, which are in contact with the convey belt 13, are electrically grounded. The driving roller 17 rotates in the direction of arrow i, and thereby the driven roller 15 rotates in a direction of arrow j following the rotation of the driving roller 17. The convey belt 13 is rotated at a speed equal to the peripheral speed of the photosensitive drum la. The convey belt 13 is provided with a belt cleaner 16 (to be described later).

A transfer device 9*a* that transfers the toner image from the photosensitive drum 1*a* to the paper P is disposed to face a surface of the convey belt 13, which is opposite to the other surface thereof facing the photosensitive drum 1*a* and paper P. A positive voltage is applied to the transfer device 9*a*. As a result, the toner image formed on the photosensitive drum 1*a* is transferred to the paper P by electrostatic force.

A charge erase device 11*a* is disposed at a position where the charge erase device 11*a* faces the part of the photosensitive drum 1*a* on which the toner image that was transferred to the paper P was present, when the photosensitive drum 1*a* is rotated, and uniformly erases a charge remaining on the surface of the photosensitive drum 1*a*. The charge erase device 11*a* comprises a light-emitting element, such as an LED, which uniformly illuminates the photosensitive drum 1*a*.

As has been described above, the first process unit 100*a* comprises the photosensitive drum 1*a*, charging device 3*a*, exposing device 5*a*, developing device 7*a* with developing roller 37*a*, transfer device 9*a*, and charge erase device 11*a*.

Similarly, the second process unit 100*b* comprises a photosensitive drum 1*b*, a charging device 3*b*, an exposing device 5*b*, a developing device 7*b* with a developing roller 37*b*, a transfer device 9*b*, and a charge erase device 11*b*.

Similarly, the third process unit 100*c* comprises a photosensitive drum 1*c*, a charging device 3*c*, an exposing device 5*c*, a developing device 7*c* with a developing roller 37*c*, a transfer device 9*c*, and a charge erase device 11*c*.

Similarly, the fourth process unit 100*d* comprises a photosensitive drum 1*d*, a charging device 3*d*, an exposing device 5*d*, a developing device 7*d* with a developing roller 37*d*, a transfer device 9*d*, and a charge erase device 11*d*.

The second process unit 100*b* is disposed at a position where the second process unit 100*b* transfers another toner image on the paper P conveyed by the convey belt 13, on which the toner image was already transferred by the first process unit 100*a*.

The third process unit 100*c* is disposed at a position where the third process unit 100*c* transfers still another toner image on the paper P conveyed by the convey belt 13, on which the toner image was transferred by the second process unit 100*b*.

The fourth process unit 100*d* is disposed at a position where the fourth process unit 100*d* transfers still another toner image on the paper P conveyed by the convey belt 13, on which the toner image was transferred by the third process unit 100*c*.

The developing device 7*a* of the first process unit 100*a* contains a yellow-series (hereinafter referred to as "yellow") developer. The developing device 7*b* of the second process unit 100*b* contains a magenta-series (hereinafter referred to as "magenta") developer. The developing device 7*c* of the third process unit 100*c* contains a cyan-series (hereinafter referred to as "cyan") developer. The developing device 7*d* of the fourth process unit 100*d* contains a black-series (hereinafter referred to as "black") developer.

A fixing device 23 is disposed at a position to where the paper P, on which the toner image is formed by the four process units, is conveyed by the convey belt 13. The toner image is fixed on the paper P by the fixing device 23.

Figure 3:
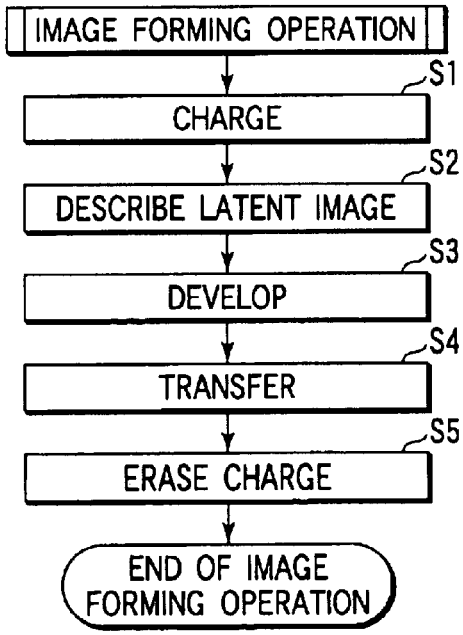
FIG. 3 is a flow chart relating to an image forming operation of the image forming apparatus.

The operation of the image forming apparatus 1 with the above-described structure will now be described with reference to a flow chart of FIG. 3.

In the first process unit 100*a*, when the rotation of the photosensitive drum 1*a* is started in the direction of arrow k in FIG. 2, the charging device 3*a* uniformly charges the surface of the photosensitive drum 1*a* (S1).

When the photosensitive drum 1*a* is further rotated so that the charged part of the surface of the photo-sensitive drum 1*a* is opposed to the exposing device Sa, the exposing device 5*a* exposes the surface of the photosensitive drum 1*a* (i.e. describes an electrostatic latent image on the surface) on the basis of the yellow image data generated by the image processing section 104 (S2).

When the photosensitive drum 1*a* is further rotated so that the part of the surface of the photosensitive drum 1*a*, on which the electrostatic latent image is described, is opposed to the developing device 7*a*, the electrostatic latent image described on the surface of the photosensitive drum 1*a* is developed into a toner image with yellow toner (S3). The yellow toner is negatively precharged adequately within the developing device 7*a*.

Subsequently, the photosensitive drum 1*a* is rotated and the transfer device 9*a* is operated at a predetermined timing. Thereby, the toner image formed on the surface of the photosensitive drum 1*a* is transferred on the paper P (S4). In this case, the paper P is conveyed by the convey belt 13 between the transfer device 9*a* and photosensitive drum 1*a*.

Toner, which has not been transferred from the photosensitive drum 1*a* to the paper P, remains on the surface of the photosensitive drum 1*a*. The photosensitive drum 1*a* is rotated with the toner remaining thereon, and a charge on the photosensitive drum is erased by the charge erase device 11*a* (S5).

The transfer process in the first process unit 100*a* is described.

In an image forming operation following step S5, the charging device 3*a* uniformly charges the surface of the photosensitive drum 1*a*. The exposing device 5*a* forms an electrostatic latent image on the charged surface of the photosensitive drum 1*a*. The developing device 7*a* develops the electrostatic latent image.

In this case, toner remaining on a part of the surface of the photosensitive drum 1*a*, where the electrostatic latent image is not formed, is attached to the developing roller 37*a* and recovered by the developing device 7*a*. On the other hand, the toner remaining on the part of the surface of the photosensitive drum 1*a*, where the electrostatic latent image is formed, remains attached to the photosensitive drum 1*a* along with toner supplied from the developing device 7*a*.

The paper P, on which the toner image is transferred by the above image forming operation of the first process unit 100*a*, is conveyed by the convey belt 13 to the position where the toner image formed by the second process unit 100*b* is to be transferred.

In the image forming operation of the second process unit 100*b*, the magenta toner image is transferred to the paper P, like the above-described image forming operation.

In the image forming operation of the third process unit 100*c*, the cyan toner image is transferred to the paper P conveyed by the convey belt 13, like the above-described image forming operation.

Finally, in the image forming operation of the fourth process unit 100*d*, the black toner image is transferred to the paper P conveyed by the convey belt 13, like the above-described image forming operation.

By these operations, the respective toner images formed by the second process unit 100*b*, third process unit 100*c* and fourth process unit 100*d* are transferred in an overlapping fashion on the paper P on which the toner image is formed by the first process unit 100*a*.

Next, the transfer process in the second process unit 100*b* is described.

The toner image developed by the first process unit 100*a* with the yellow toner is transferred on the paper P.

In the second process unit 100*b*, the toner image developed with the magenta toner is transferred on the paper P on which the yellow toner image is already transferred. In this case, the magenta toner image is transferred to the paper P from the photosensitive drum 1*b*, and at the same time toner of the yellow toner image is reversely transferred from the paper P to the photosensitive drum 1*b*. In other words, both the magenta toner, which is not transferred to the paper P and remains on the photosensitive drum 1*b*, and the reversely transferred yellow toner, are attached to the photosensitive drum 1*b*.

Subsequently, the photosensitive drum 1*b* with the toner attached is rotated, and a charge on the photosensitive drum 1*b* is erased. The charge-erased photosensitive drum 1*b* is charged once again by the charging device 3*b*, and an electrostatic latent image is formed on the photosensitive drum 1*b* by the exposing device 5*b*.

The toner remains attached to the surface of the photosensitive drum 1*b* on which the electrostatic latent image is newly formed. Toner, which is attached to a part of the surface of photosensitive drum 1*b*, other than the part with the formed electrostatic latent image, is electrically attracted to the developing roller 37*b* of developing device 7*b* and is removed from the surface of the photosensitive drum 1*b*. The yellow toner attracted to the developing roller 37*b* of developing device 7*b* needs to be discharged to the outside of the developing device 7*b*.

As will be described later in detail, in the present embodiment, the necessity/non-necessity of the discharge operation is determined at a predetermined timing. If "necessity" is determined, a solid image of toner (hereinafter referred to as "solid toner image") is formed on the photosensitive drum 1*b* and discharged.

Hereafter, this determination and the discharge operation are described together as a discharge routine.

The mixed toner, as described above, is discharged to the outside of the toner developing device 7*b* in the following manner. A solid electrostatic latent image of a predetermined size is formed on the surface of the photosensitive drum 1*b* which has been uniformly charge-erased. The solid electrostatic latent image is developed into a solid toner image, and thus the toner is discharged. Specifically, the solid toner image is transferred to the convey belt 13. The solid toner image transferred to the convey belt 13 is removed by the belt cleaner 16.

As has been described above, in the second process unit 100*b*, the reversely transferred yellow toner on the photosensitive drum 1*b* is electrically attracted to the developing roller 37*b* and mixed in the magenta toner in the developing device 7*b*. Similarly, in the third process unit 100*c*, the yellow and magenta toners mix in the cyan toner in the developing device 7*c*. In addition, in the fourth process unit 100*d*, the yellow, magenta and cyan toners mix in the black toner in the developing device 7*d*.

Thus, the mixed toner discharge operation is suitably performed in each process unit.

Figure 4:
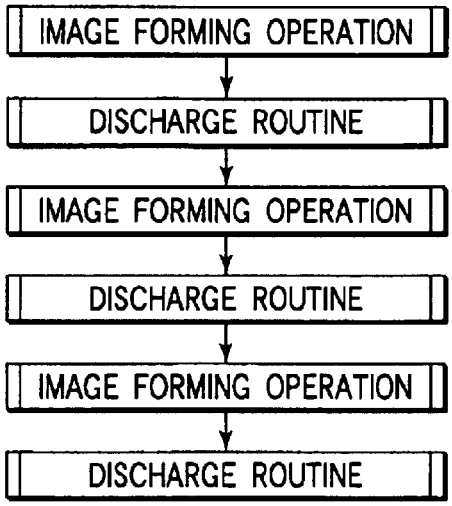
FIG. 4 is a first flow chart illustrating a timing of necessity/non-necessity determination of a discharge operation.

As regards the timing of the execution of the discharge routine, as shown in a flow chart of FIG. 4, the discharge routine is executed each time the image forming operation is completed. In this case, a solid toner image is formed on that portion of the convey belt 13, which lies between paper sheets conveyed.

Figure 5:
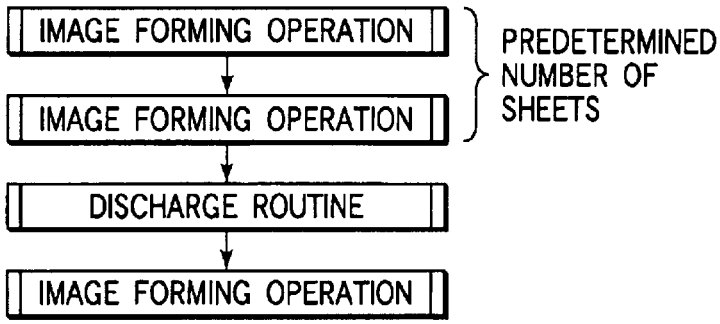
FIG. 5 is a second flow chart illustrating a timing of necessity/non-necessity determination of a discharge operation.

Alternatively, as shown in a flow chart of FIG. 5, in a case where toner images are successively formed on a plurality of paper sheets, the discharge routine may be executed after image forming operations for a predetermined number of paper sheets are completed.

Figure 6:
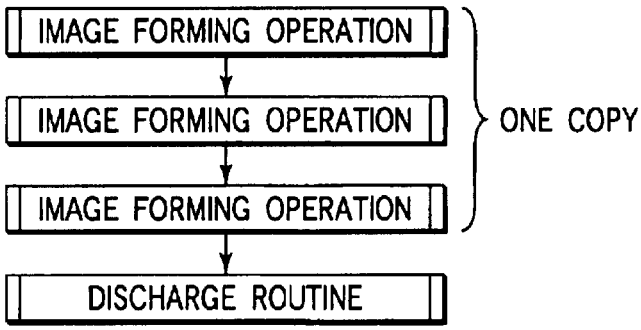
FIG. 6 is a third flow chart illustrating a timing of necessity/non-necessity determination of a discharge operation.

Alternatively, as shown in a flow chart of FIG. 6, the discharge routine may be executed after successive image forming operations for a single copy consisting of a plurality of paper sheets are completed.

Alternatively, the discharge routine may be executed after a predetermined time period has passed since the last image forming operation was finished.

Alternatively, the discharge routine may be executed at predetermined time intervals.

Alternatively, the discharge routine may be executed, depending on whether a toner image formation area in each process unit has reached a predetermined value.

Next, the execution of the discharge routine based on the toner image formation area is described.

Figure 7:
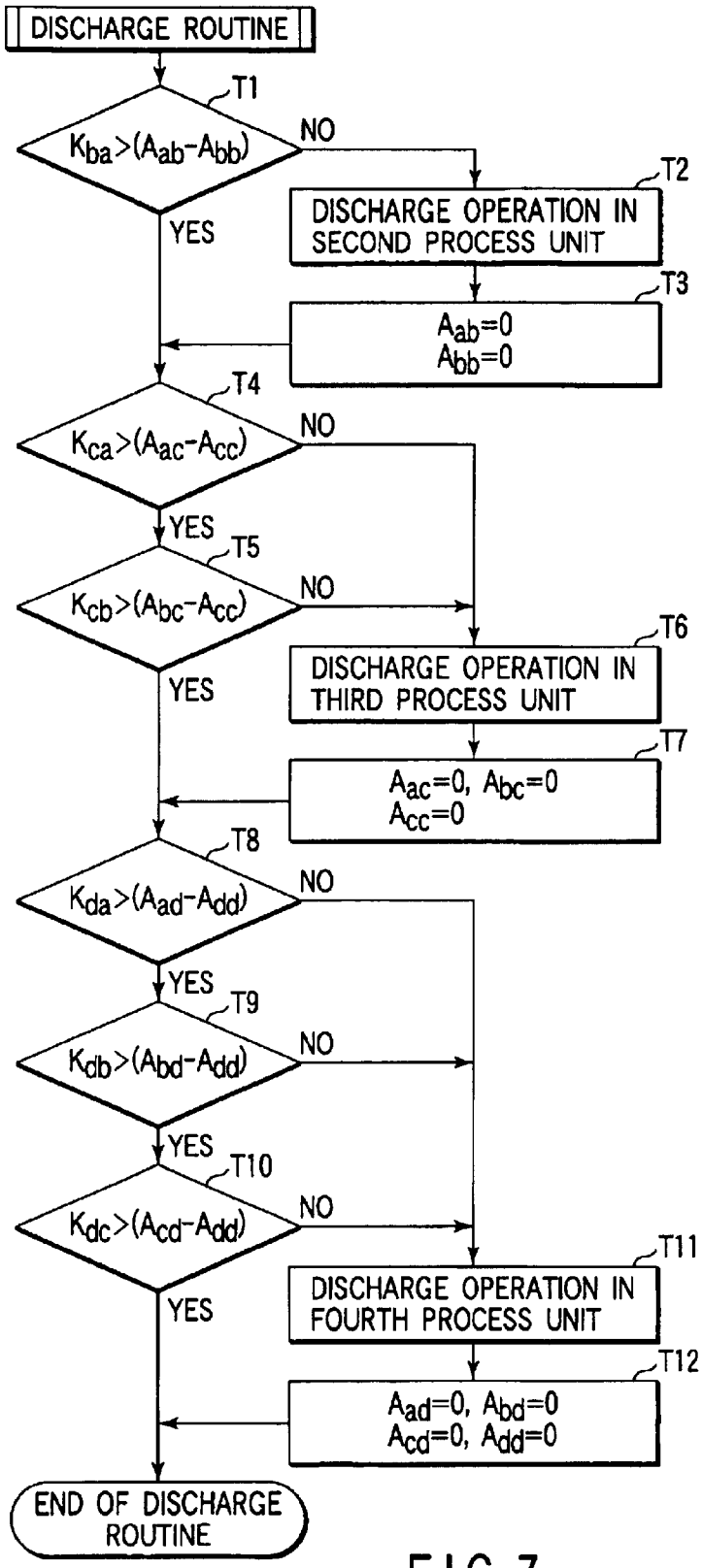
FIG. 7 is a first flow chart relating to necessity/non-necessity determination of a discharge operation.

The determination by the control section 102 with respect to the necessity/non-necessity of the discharge operation will be described with reference to a flow chart of FIG. 7.

The amount of toner used in toner image formation relates to the area of a toner image. The area of a toner image, in turn, relates to an area where a charged photosensitive drum surface is exposed by an exposing device and charge-erased. Thus, the amount of reversely transferred toner can be estimated from the exposure area of the exposing device. The exposure area may be found by measuring the area of the toner image formed on the photosensitive drum (1*a* to 1*d*). Alternatively, it may be found by a reverse calculation of the area excluding the area of the toner image. Further, since the exposing operation is performed based on the image data generated by the image processing section 104, the exposure area may be calculated from this image data.

In the first process unit 100*a*, the area of the surface of the photosensitive drum 1*a* exposed by the exposing device 5*a* is found by integrated calculations by the control section 102 as three values: an integrated exposure area Aab for the second process unit 100*b*, an integrated exposure area Aac for the third process unit 100*c* and an integrated exposure area Aad for the fourth process unit 100*d*.

In the second process unit 100*b*, the area of the surface of the photosensitive drum 1*b* exposed by the exposing device 5*b* is found by integrated calculations by the control section 102 as at least three values: an integrated exposure area Abb for the second process unit 100*b*, an integrated exposure area Abc for the third process unit 100*c* and an integrated exposure area Abd for the fourth process unit 100*d*.

In the third process unit 100*c*, the area of the surface of the photosensitive drum 1*c* exposed by the exposing device 5*c* is found by integrated calculations by the control section 102 as at least two values: an integrated exposure area Acc for the third process unit 100*c* and an integrated exposure area Acd for the fourth process unit 100*d*.

In the fourth process unit 100*d*, the area of the surface of the photosensitive drum 1*d* exposed by the exposing device 5*d* is found by integrated calculations by the control section 102 as an integrated exposure area Add for the fourth process unit 100*d*.

A mixed toner discharge operation of the second process unit 100*b* is determined to be "necessary" if a value, which is obtained by subtracting the integrated exposure area Abb of the exposing device 5*b* of the second process unit 100*b* from the integrated exposure area Aab of the exposing device 5*a* of the first process unit 100*a*, is not less than a predetermined value Kba (T1). This determination is based on the following consideration. Of the toner reversely transferred to the photosensitive drum 1*b* of second process unit 100*b* from the toner image formed on the paper sheet P by the first process unit 100*a*, a toner portion, which is reversely transferred to that part of the photosensitive drum 1*b* of the second process unit 100*b*, where the electrostatic latent image is not formed by the exposing device 5*b*, is mainly taken into the developing device 7*b*.

If the discharge operation is determined to be "necessary" in step T1, the discharge operation is performed (T2), and values Aab and Abb are restored to "0" (T3).

Similarly, a mixed toner discharge operation of the third process unit is determined to be "necessary" if a value, which is obtained by subtracting the integrated exposure area Acc of the exposing device 5*c* of the third process unit 100*c* from the integrated exposure area Aac of the exposing device 5*a* of the first process unit 100*a*, is not less than a predetermined value Kca (T4).

Alternatively, the mixed toner discharge operation of the third process unit 100*c* is determined to be "necessary" if a value, which is obtained by subtracting the integrated exposure area Acc of the exposing device 5*c* of the third process unit 100*c* from the integrated exposure area Abc of the exposing device 5*b* of the second process unit 100*b*, is not less than a predetermined value Kcb (TS).

If the discharge operation is determined to be "necessary" in step T4 or T5, the discharge operation is performed (T6), and values Aac, Abc and Acc are restored to "0" (T7).

A mixed toner discharge operation of the fourth process unit is determined to be "necessary" if a value, which is obtained by subtracting the integrated exposure area Add of the exposing device 5*d* of the fourth process unit 100*d* from the integrated exposure area Aad of the exposing device 5*a* of the first process unit 100*a*, is not less than a predetermined value Kda (T8).

Alternatively, the mixed toner discharge operation of the fourth process unit is determined to be "necessary" if a value, which is obtained by subtracting the integrated exposure area Add of the exposing device 5*d* of the fourth process unit 100*d* from the integrated exposure area Abd of the exposing device 5*b* of the second process unit 100*b*, is not less than a predetermined value Kdb (T9).

Alternatively, the mixed toner discharge operation of the fourth process unit is determined to be "necessary" if a value, which is obtained by subtracting the integrated exposure area Add of the exposing device 5*d* of the fourth process unit 100*d* from the integrated exposure area Acd of the exposing device 5*c* of the third process unit 100*c*, is not less than a predetermined value Kdc (T10).

If the discharge operation is determined to be "necessary" in step T8, T9 or T10, the discharge operation is performed (T11), and values Aad, Abd, Acd and Add are restored to "0" (T12).

The predetermined values Kba, Kca, Kcb, Kda, Kdb and Kdc may be equal. However, if these values are set independently in consideration of the relationship between the amount of mixture of other color toner and the toning of color tone of the toner image formed on the paper P, a more effective discharge operation can be performed.

As described above, not only the process unit that formed the toner image immediately before (i.e. the process unit preceding by one) is monitored with respect to the toner image area. But all the process units that previously formed toner images are monitored.

When only the process unit that formed the toner image immediately before is monitored, the following problem arises. For example, there may be a case where the yellow toner image formation integrated area in the first process unit is very large, while the magenta and cyan toner image formation integrated areas in the second and third process units are very small. In such a case, the magenta toner is normally discharged, but the cyan toner is not discharged since the difference between the cyan toner image formation area and the magenta toner image formation area is small. Consequently, a large amount of mixed yellow toner cannot be discharged.

In this embodiment, all the process units that previously formed toner images are monitored. Thereby, the occurrence of this undesirable situation is prevented.

It is thus possible to prevent such a situation that the toner of the process unit that forms a third or a following toner image is not discharged and mixed toner remains. Therefore, the toning of color tone of the toner image can be constantly maintained.

Aside from the above, another determination method is available.

Figure 8:
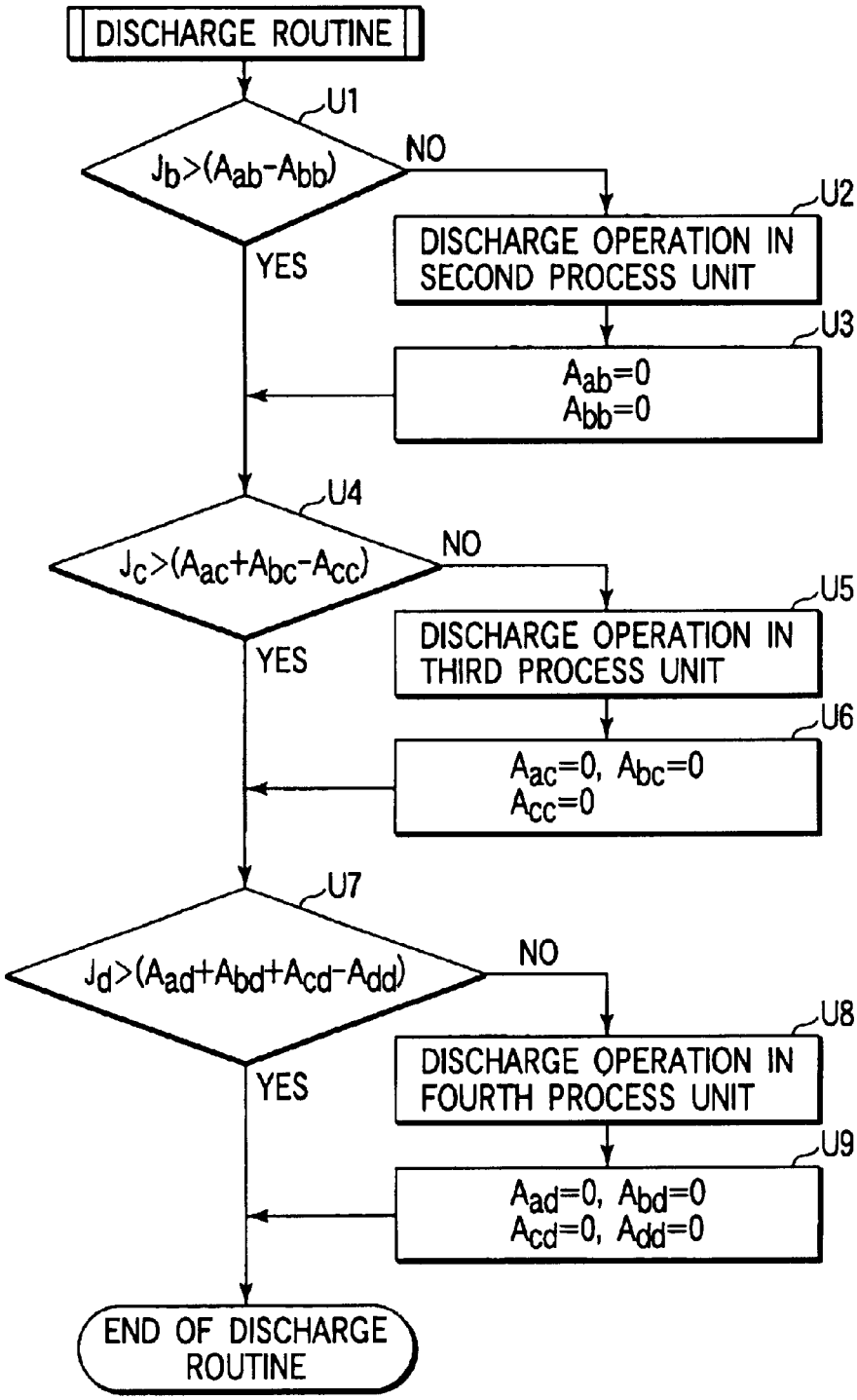
FIG. 8 is a second flow chart relating to necessity/non-necessity determination of a discharge operation.

The determination by the control section 102 with respect to the necessity/non-necessity of the discharge operation will be described with reference to a flow chart of FIG. 8.

A mixed toner discharge operation of the second process unit is determined to be "necessary" if a value, which is obtained by subtracting the integrated exposure area Abb of the exposing device 5*b* of the second process unit 100*b* from the integrated exposure area Aab of the exposing device 5*a* of the first process unit 100*a*, is not less than a predetermined value Jb (U1).

If the discharge operation is determined to be "necessary" in step U1, the discharge operation is performed (U2), and values Aab and Abb are restored to "0" (U3).

A mixed toner discharge operation of the third process unit is determined to be "necessary" if a value, which is obtained by subtracting the integrated exposure area Acc of the exposing device 5*c* of the third process unit 100*c* from a sum of the integrated exposure area Aac of the exposing device 5*a* of the first process unit 100*a* and the integrated exposure area Abc of the exposing device 5*b* of the second process unit 100*b*, is not less than a predetermined value Jc (U4). This procedure aims at finding a toner discharge amount by taking into account the reverse transfer toner amount from both the yellow toner image formed on the paper P by the first process unit 100*a* vand the magenta toner image formed by the second process unit 100*b*.

If the discharge operation is determined to be "necessary" in step U4, the discharge operation is performed (U5), and values Aac, Abc and Acc are restored to "0" (U6).

A mixed toner discharge operation of the fourth process unit 100*d* is determined to be "necessary" if a value, which is obtained by subtracting the integrated exposure area Add of the exposing device 5*d* of the fourth process unit 100*d* from a sum of the integrated exposure area Aad of the exposing device 5*a* of the first process unit 100*a*, the integrated exposure area Abd of the exposing device 5*b* of the second process unit 100*b* and the integrated exposure area Acd of the exposing device 5*c* of the third process unit 100*c*, is not less than a predetermined value Jd (U7). In this case, in the fourth process unit 100*d*, toner is reversely transferred from the toner image formed on the paper P by the first process unit 100*a*, the toner image formed by the second process unit 100*b* and the toner image formed by the third process unit 100*c*. This, the toner discharge amount in the fourth process unit 100*d* is determined in consideration of the amount of reverse transfer toner from the three toner images.

If the discharge operation is determined to be "necessary" in step U7, the discharge operation is performed (U8), and values Aad, Abd, Acd and Add are restored to "0" (U9).

As described above, the necessity/non-necessity of the execution of the discharge operation is determined by considering how many toner images are already formed on the paper P. Therefore, a deficiency in the amount of discharge toner can be prevented.

In addition to the above-described determination methods, still another determination method is available.

Figure 9:
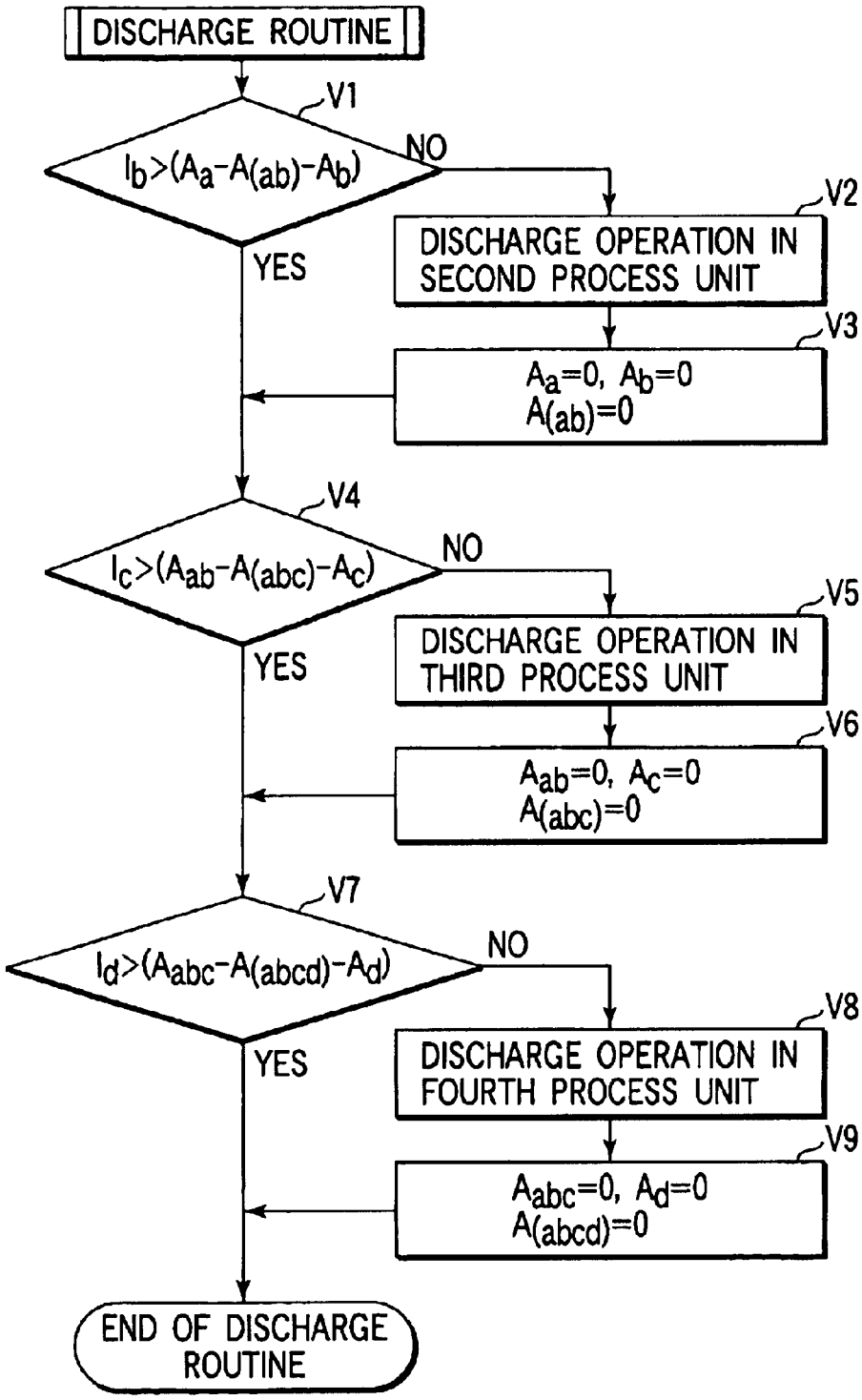
FIG. 9 is a third flow chart relating to necessity/non-necessity determination of a discharge operation.

The determination by the control section 102 with respect to the necessity/non-necessity of the discharge operation will be described with reference to a flow chart of FIG. 9.

In this method, an overlapping part of previously formed toner images on the paper P is considered.

Figure 10:
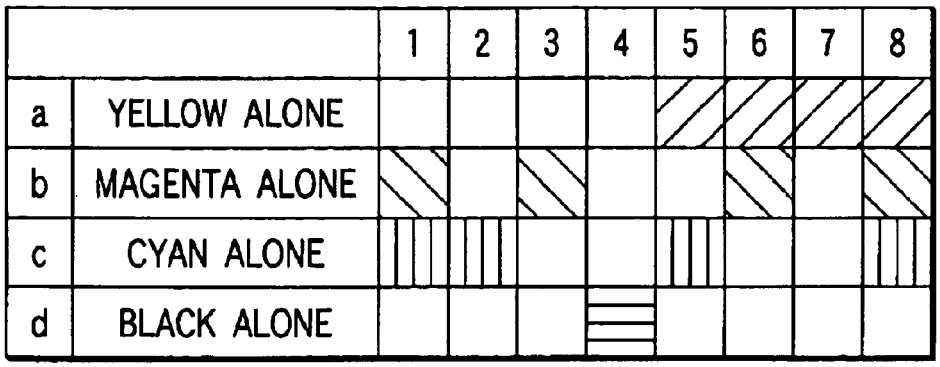
FIG. 10 is a diagram of images formed of yellow, magenta, cyan and black toners.
Figure 11:
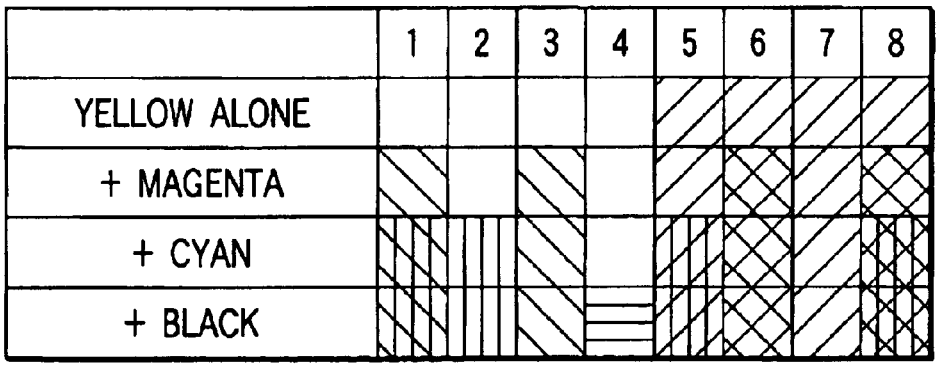
FIG. 11 is a diagram of images formed by overlapping in succession a magenta toner image, a cyan toner image and a black toner image on a sheet on which a yellow toner image is formed.

The outline of this method is described with reference to FIG. 10 and FIG. 11, which schematically illustrate color images each comprising eight dots. FIG. 10 shows images formed of yellow, magenta, cyan and black toners, respectively. FIG. 11 shows images wherein a magenta toner image, a cyan toner image and a black toner image are successively overlaid on a yellow toner image on the paper P.

As is shown in FIG. 10, in the first process unit 100*a*, yellow toner dots are formed at dot positions 5, 6, 7 and 8. In the second process unit 100*b*, magenta toner dots are formed at dot positions 1, 3, 6 and 8. In the third process unit 100*c*, cyan toner dots are formed at dot positions 1, 2, 5 and 8. In the fourth process unit 100*d*, a black toner dot is formed at a dot position 4.

In this case, the necessity/non-necessity of the discharge operation in the second process unit 100*b* is determined as follows.

To start with, the area of the yellow toner image is found. If the area of the image is expressed by the number of dots, the area is four dots (dot positions 5, 6, 7 and 8) as shown in FIG. 10. This area is represented by Aa. Then, the area of the magenta toner image is found. The area, like Aa, is four dots (dot positions 1, 3, 6 and 8). This area is represented by Ab. An overlapping area between the yellow toner image and the magenta toner image is found. As shown in FIG. 11, these toner images overlap at dot positions 6 and 8, and thus the overlapping area is two dots. This area is represented by A(ab).

If a value, which is obtained by subtracting the overlapping area A(ab) of the yellow toner image and magenta toner image and the entire area Ab of the magenta toner image from the entire area Aa of the yellow toner image, is not less than a predetermined value Ib, the discharge operation is determined to be "necessary" (V1).

If the discharge operation is determined to be "necessary" in step V1, the discharge operation is performed (V2), and integrated values Aa, Ab and A(ab) are restored to "0" (V3).

The necessity/non-necessity of the discharge operation in the third process unit 100*c* is determined as follows.

To begin with, the area of the image already formed of yellow and magenta toners is found. This area is six dots (dot positions 1, 3, 5, 6, 7 and 8) as shown in FIG. 11. This area is represented by Aab. Then, the area of the cyan toner image is found. The area is four dots (dot positions 1, 2, 5 and 8) as shown in FIG. 10. This area is represented by Ac. An overlapping area between the already formed image and the cyan toner image is found. As shown in FIG. 11, these toner images overlap at dot positions 1, 5 and 8, and thus the overlapping area is three dots. This area is represented by A(abc).

If a value, which is obtained by subtracting the overlapping area A(abc) of the already formed image and cyan toner image and the entire area Ac of the cyan toner image from the entire area Aab of the already formed image, is not less than a predetermined value Ic, the discharge operation is determined to be "necessary" (V4).

If the discharge operation is determined to be "necessary" in step V4, the discharge operation is performed (V5), and integrated values Aab, Ac and A(abc) are restored to "0" (V6).

The necessity/non-necessity of the discharge operation in the fourth process unit 100*d* is determined as follows.

To begin with, the area of the image already formed of yellow, magenta and cyan toners is found. This area is seven dots (dot positions 1, 2, 3, 5, 6, 7 and 8) as shown in FIG. 11. This area is represented by Aabc. The area of the black toner image is one dot (dot position 4), and this area is represented by Ad. An overlapping area between the already formed image and the black toner image is found. As shown in FIG. 11, these toner images do not overlap at all, and thus the overlapping area is zero (0 dot). This area is represented by A(abcd). In a region where a black toner image is to be formed, a clear black image formed of black toner alone is desired. Thus, in many cases, it is desirable to prevent overlapping of other color toners in the region where the black toner image is to be formed.

If a value, which is obtained by subtracting the overlapping area A (abcd) of the already formed image and black toner image and the entire area Ad of the black toner image from the entire area Aabcd of the already formed image, is not less than a predetermined value Id, the discharge operation is determined to be "necessary" (V7).

If the discharge operation is determined to be "necessary" in step V7, the discharge operation is performed (V8), and integrated values Aabcd, Ad and A (abcd) are restored to "0" (V9).

Overlapping parts of toner images can be discriminated by performing AND operations for the dots corresponding in position to the image data units of yellow, magenta, cyan and black.

In front of each process unit, a sensor (CCD, photosensor, etc.) may be provided which directly measures the area of a composite toner image of yellow and magenta, or a composite toner image of yellow, magenta and cyan. In this case, there is no need to consider at which parts the toner images overlap.

As described above, double or triple integrations of overlapping parts of toner images are prevented, and the area of the previously formed toner image on the paper P is exactly determined. Thereby, excessive discharge of mixed toner can be prevented.

In the present invention, the timing for discharging the toner in the developing device, in which the toner of the previously formed toner image has mixed, is determined by comparing the integrated area of the toner image developed by the upstream-side developing device and the integrated area of the toner image developed by the present developing device. Therefore, this invention is applicable not only to a two-component toner developing method, but also to a developing method using one-component nonmagnetic or magnetic toner.

The present invention is applicable to cases where the charge polarities of the toner and photosensitive drums are different.

This invention is not limited to the technique wherein the operation for discharging toner from the developing device is effected by solid image printing of toner. For example, this invention is applicable to a technique wherein toner is discharged from the developing device to a waste toner box.

As has been described above, according to the present embodiment, it is possible to constantly maintain the toning of color tone of toner images by discharging mixed toner at a suitable timing, even if a previously formed toner image mixes in an image forming section that performs a subsequent image forming operation.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A mixed toner discharge control method for an image forming apparatus having a first developing device that performs development using a first toner, a second developing device that performs development using a second toner, a third developing device that performs development using a third toner and a fourth developing device that performs development using a fourth toner, wherein a toner image using the first toner is first formed on paper supplied, following which a toner image using the second toner is formed in an overlapping manner, a toner image using the third toner is formed in an overlapping manner and then a toner image using the fourth toner is formed in an overlapping manner, the method comprising:

controlling a discharge operation for the first toner mixed in the second developing device, in accordance with an integrated area developed by the first developing device and an integrated area developed by the second developing device;

controlling a discharge operation for the first and second toners mixed in the third developing device, in accordance with an integrated area developed by the first developing device, an integrated area developed by the second developing device and an integrated area developed by the third developing device; and controlling a discharge operation for the first, second and third toners mixed in the fourth developing device, in accordance with an integrated area developed by the first developing device, an integrated area developed by the second developing device, an integrated area developed by the third developing device and an integrated area developed by the fourth developing device.

* * * * *